US005251894A

United States Patent [19]

Boatman

[11] Patent Number: 5,251,894

[45] Date of Patent: Oct. 12, 1993

[54] BASEBALL BASE WITH FORCE ABSORBING SLIDE FEATURE

[75] Inventor: Jesse G. Boatman, Baxter, Tenn.

[73] Assignee: Adams USA Inc., Cookeville, Tenn.

[21] Appl. No.: 988,289

[22] Filed: Dec. 8, 1992

[51] Int. Cl.[5] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 2,624,580 | 1/1953 | Corbett | 273/25 |
| 3,572,705 | 3/1971 | Wyble | 273/25 |
| 4,723,779 | 2/1988 | Hauser | 273/25 |
| 4,915,383 | 4/1990 | Yamakuchi | 273/25 |
| 4,976,430 | 12/1990 | Brandon | 273/25 |
| 4,979,740 | 12/1990 | Hall | 273/25 |
| 5,000,447 | 3/1991 | Bartoli | 273/25 |
| 5,080,356 | 1/1992 | Green | 273/25 |

*Primary Examiner*—Theatrice Brown
*Attorney, Agent, or Firm*—Vance A. Smith

[57] ABSTRACT

A base for use in the game of baseball comprising a resilient curved top wall having perpendicular downwardly extending side walls connected to define corners of a truncated frustrum of a pyramid. A post member is attached to the under surface of the top wall and centrally thereof. A first plurality of spaced ribs extending from the post member to a perpendicular midpoint of the side walls and the corners defined by the side walls, the ribs further being attached to the under surface of the top wall. A second plurality of spaced ribs running substantially normal to and connecting the inner surfaces of opposite side walls at points intermediate the midpoints and corners. A base anchor is provided for receiving the post member for receiving the post member to fasten the base to a playing field.

14 Claims, 2 Drawing Sheets

BASEBALL BASE WITH FORCE ABSORBING SLIDE FEATURE

TECHNICAL FIELD

This invention is related to articles used for bases for baseball games and the like and, more particularly, to bases having anchoring features preventing movement of the baseball base under normal playing conditions and to absorb the force of the impact of runners sliding into and over the base.

BACKGROUND OF THE INVENTION

The prior art is replete with baseball bases designed to reduce the impact of players running on or over or sliding into the bases. Generally, when a runner slides into a base, the rebound force can be significant and adversely affect the runner. An example of a base to reduce the impact is described in U.S. Pat. No. 4,723,779 issued Feb. 9, 1988 to M. A. Hauser. The patent sets forth an elastomeric baseball base having tapered side walls and a flat top surface. According to the patent, the side walls of the base curve from an almost vertical position near the playing surface, then flattens out and finally curves again into the top surface of the base. The base itself fits over a plate attached to an anchoring member.

U.S. Pat. No. 2,440,042 to Friedman discloses another base having curved sides and a flat top surface. The configuration of the base is evidently not related to safety but serves to facilitate visual indication of when a runner has a foot on the base.

A baseball base having a yieldable internal structure is disclosed in U.S. Pat. No. 3,204,958 issued on Sep. 5, 1963 to Velasquez. A thick resilient portion made of elastomeric material is releasably mounted to a separate rigid pad assembly which itself is coupled to an anchoring post by springs. The sides of the base are vertical to the playing field and the top thereof is flat.

U.S. Pat. No. 2,122,266 issued Jun. 28, 1938 to Seys describes a home plate having a beveled border that reduces the incidence of a runner catching of spikes on the surface of the home plate. The bevelled portion joins the flat top surface of the plate. Openings in the plate are threaded to receive complimentary threaded pins that are driven into the playing field to prevent horizontal motion of the plate during use.

U.S Pat. No. 2,220,142 to Braxton issued Nov. 5, 1940 discloses a baseball bag having vertical sides joined to a convex top. The bag is filled with excelsior or sawdust or other appropriate material. According to the patentee, the convexity provides a smooth banked surface to a runner. The base is provided with a plurality of straps designed to fasten the base to anchoring spikes having eyes through which the straps can be pulled and fastened.

U.S. Pat. No. 5,000,447 issued to Bartoli on Mar. 19, 1991 describes an energy absorbing base having a hollow underside with ribs arranged in a "chevron-like" pattern. The design of the ribs allow the sides of the base to flex inwardly toward the center due to the impact of a runner. It is clear that the base as described in the patent effectively dampens any re bound force against the runner. In some instances, however, particularly upon a direct impact perpendicular to the center line of one of the sides of the base, it is likely that the deflection can be too severe resulting in the entanglement of the runner's spikes in the base distorted by the impact.

In reviewing the above prior art, it has become apparent that none disclose an integral lightweight, but yieldable, baseball base that provides a surface that substantially diverts the motion of sliding players over the base while reducing but not eliminating the rebound force of the base against the runner immediately following impact.

In reviewing the prior art, it has become apparent that none disclose an integral lightweight, but yieldable, baseball base that provides a surface enhancing the safety of players running over and sliding into the base. It is therefore a paramount object of the present invention to provide such a base that can also be fabricated economically.

SUMMARY OF THE INVENTION

A baseball base in accordance with the present invention comprises a parabolically curved top wall integrally joining the top edges of four side walls tapering at an angle of no more than about 45° to the horizontal playing surface. The under surface of the top wall and the inner surfaces of the side walls are integrally joined by a plurality of sets of vertically oriented thin ribs. One set of ribs radially emanates from the center post descending from the center of the top wall and connects the corners formed by the sidewalls. A second set of ribs runs normal to and integrally connects opposing side walls. The center member is integrally secured to an anchoring post. The anchoring post is keyed to an anchoring member secured within the playing surface. The lower edges of the ribs and side walls are co-planar and collectively define a support surface for the base on the horizontal playing surface.

Other objects of the present invention will become readily apparent to those skilled in the art from the following description wherein there is shown and described a preferred embodiment of the present invention. As it will be realized, the invention is capable of other and different embodiments, and its several details are capable of modifications in various, obvious aspects, all without departing from the invention. Accordingly, the drawing and descriptions will be regarded as illustrative in nature and not as restrictive.

DETAILED DESCRIPTION OF THE PREFERRED EMBODIMENT

Figure 3:
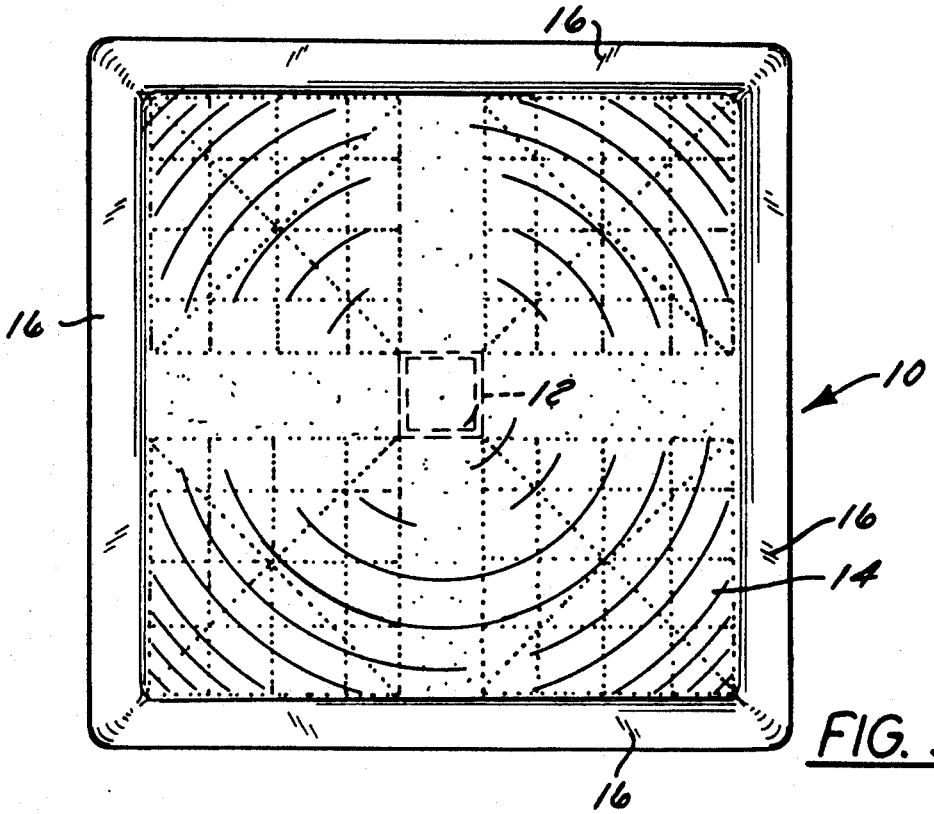
FIG. 3 is a top view of the baseball base in accordance with the present invention.

The baseball base in accordance with the present invention is depicted generally by character numeral 10 and is generally molded about and secured to an anchor post 12 adapted to receive and itself be secured to an anchor member 24 positioned within the ground beneath a horizontal playing field 26. As shown, anchoring post 12 is hollow and has a rectangular cross-section and fits within a complimentary cavity of member 24.

Alternatively, however, the anchoring post 12, being hollow, could receive an anchoring member with a complimentary configuration internally. In either situation, post 12 would be keyed to member 24 and thus constrained against rotational and horizontal motion, both angular and linear, relative to playing surface 26. Post 12 and member 24 are preferably made from material resistant to environmental deterioration. A preferred material is zinc- plated aluminum although plastic material having abrasion resistance characteristics may also be employed. In another alternative, it may be desirable to mold the entire base from a single piece of suitable elastomeric material.

Base 10 is comprised of a top wall 14, transitional side walls 16, and sets 18 and 19 of spaced vertical oriented ribs. Set 18 comprises four ribs radially diverging from a central boss 20, descending from the center of under surface 14*a* of top wall 14, to corners formed by sidewalls 16. Ribs 18 integrally join under surface 14*a* to the inner surfaces 16*a* of side walls 16. Ribs 19, running normal to and connecting opposing side walls 16, are additionally joined to under surface 14*a* and the inner surfaces 16*a* of sidewalls 16.

Figure 2:
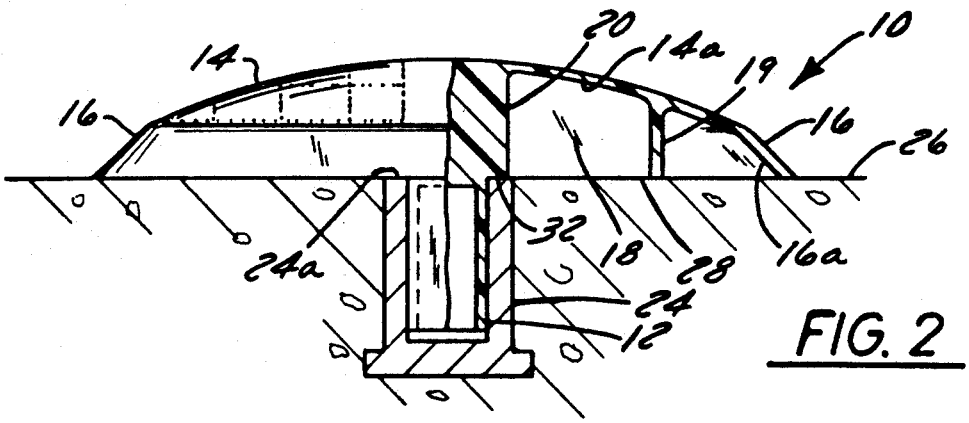
FIG. 2 is a side view of the baseball base, partially in side section, secured to an anchoring member positioned within the playing field.

When base 10 is anchored in place through the cooperating action of anchor post 12 and anchor member 24, the bottom edges 28 of ribs 18 and 19, the bottom edges 30 of side walls 16, and the bottom surface of flange 32 of boss 20, being essentially co-planar, collectively form a support surface which abuts horizontal playing surface 26. This is best seen in FIG. 2. Flange 32 actually bears against the top edges 24*a* of anchor member 24 defining the opening receiving anchor post 12. Top edges 24*a* are flush with horizontal playing surface 26.

Transitional side walls 16 define a frustum of a square pyramid with about 15 inch sides and extend a maximum vertical elevation about 1 inch high above the horizontal playing surface 26. Curved top wall 14 is preferably a parabolically curved surface reaching a maximum vertical elevation at the vertical center axis of base 10 of about 2.5 inches above the horizontal playing surface 26 and integrally joins the side walls 16 at their maximum elevation. The numerical values given for the elevations above are generally for use in baseball games and may, of course be varied within the limits set within for other base type games and therefore are not meant to be limiting.

Structurally, base 10 is preferably molded as a single piece by conventional hydraulic compression molding. Suitable compositions are commonly available resilient materials capable of being molded and cured such as natural rubber, various synthetic elastomers or combinations thereof with filler materials such as clay, whiting talc and/or silica. For improved resistance to ultraviolet degradation titanium dioxide and the like may be added also. Vulcanization may be accomplished through the addition of sulfur, a sulfur donor or peroxide systems.

The anchor post is placed in the same mold as the material used for the composition of the base 10. The mold is then closed and the compression molding cycle is commenced. By virtue of being part of the molding process, the anchor post becomes an integral part of the base itself. This modular one piece structure minimizes maintenance of the anchoring system because of the elimination of hardware likely to become loose during use.

The top wall 14, side walls 16 and ribs 18, preferably have the same widths, and, depending mainly upon the type of composition used, be about ¼ to ½ inches thick, i.e. in width. Thus, it is clear that the space enclosed by the top wall 14 and side walls 16 is mainly empty, i.e., hollow. This means that the base 10 is very light in weight, a desirable feature. On the other hand, base 10 should resist impact and not permit over flexing of the base into the central region of the base. Ribs 18 and 19, provide strength and stiffness to base 10 without adding significant weight. Applicant has found that the particular configuration of ribs shown absorbs the impact without large internal deflection of the side walls. This configuration includes ribs 18 that radially diverge from central boss 20 to the corners formed by the side walls 16 and a second set of ribs running normal to and connecting opposing side walls 16. Ribs 19, while deflecting slightly to absorb the force of impact, also serve to minimize large distortions due to forces created by normal impacts to a side of base 10. A typical impact will cause deflection of adjacent ribs toward the point of impact and a rapid recovery will occur. Because the ribs are arranged substantially normal side distortion of the side is minimized. Ribs 18 serving primarily to reinforce the corners of base 10 are largely unaffected by impact unless the impact occurs in close proximity thereto. In such cases, rib 18 and the adjacent side wall 16 combine to resist distortion.

Figure 1:
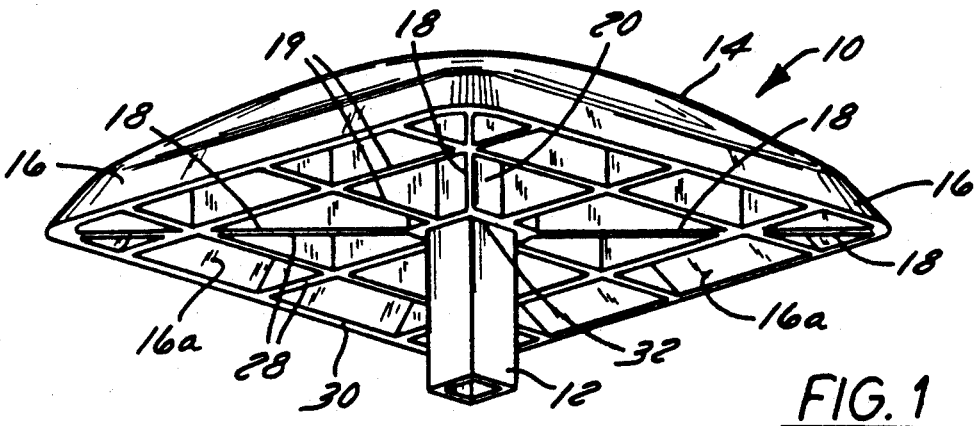
FIG. 1 is a perspective view of the baseball base in accordance with the present invention viewed from a position slightly beneath the base.
Figure 4:
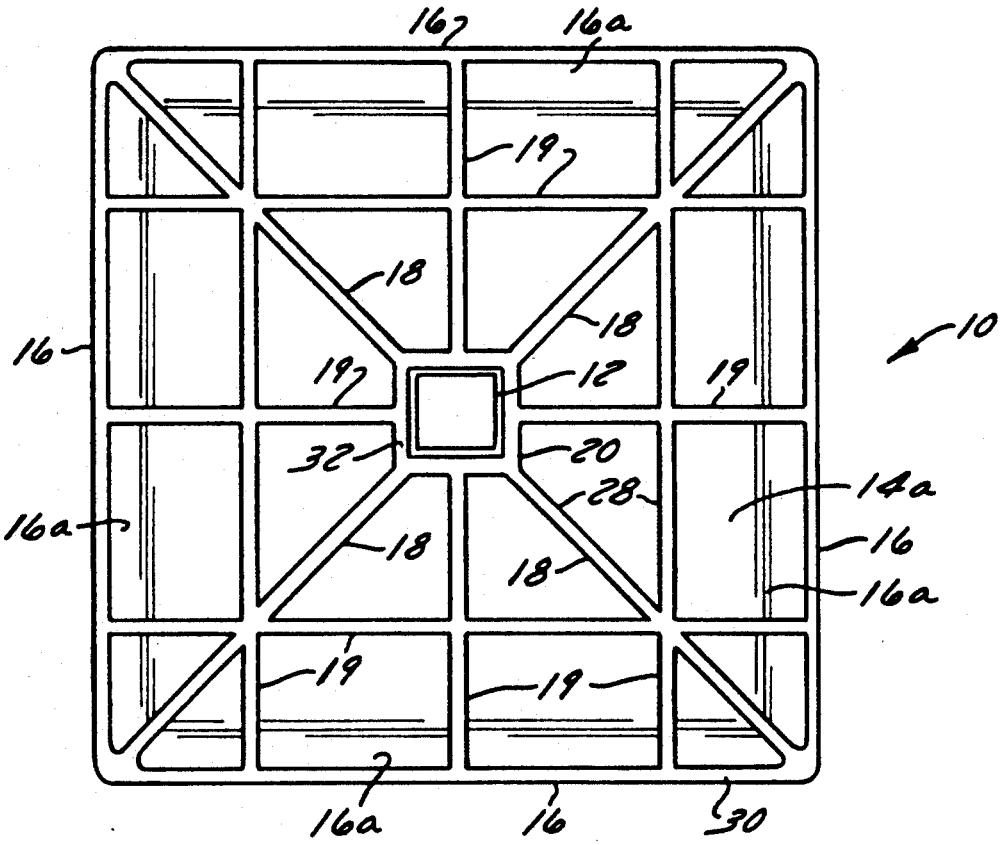
FIG. 4 is a bottom view of the baseball base in accordance with the present invention.

While the design of the base is primarily to absorb and deflect the impact of a base runner against the base over a short time period and thus gradually absorb the runner's velocity, the top surface can also be provided with a grain or stipple pattern to enhance friction against slippage of a player's foot while standing or running over the top of the base. Alternatively, the base can covered with a material that accomplishes the same function. However, in most circumstances the natural frictional forces that are created between the composition used for the base 10 and the player's shoe are such that problems with slippage are minimal. The material can be provides with a friction enhancing pattern such as that shown in FIG. 1 if desired.

As a runner slides into base 10, the angle of sliding impact with the base is typically only slightly above the horizontal playing surface. Since the angle of the sloping side wall to the horizontal playing field is no greater than about 45°, the resultant forces are tangential to and normal to the surface of the side wall. However, the normal component and its reactive force will be significantly smaller than in the case of a vertical side wall, thus reducing the amount of reactive force transmitted back to the player. Additionally, the higher tangential force will aid the player to slide up the side surface onto and over the top surface. The hollow nature of base 10 and the temporary deformation of the walls and ribs in the vicinity of the impact further reduce the reactive force. Thus, the force of impact is absorbed by the resiliency offered both by the composition of the base itself and the physics of its structure. Rather than being abruptly stopped as with the case of impact with prior art bases, the player's body will be decelerated over a longer period of time resulting in a lesser reactive force being experienced by the player.

In this disclosure, there is shown and described only the preferred embodiment of the invention, but it is understood that the invention is capable of changes and modifications within the scope of the inventive concept as expressed herein.

I claim:

1. A base for use in games where players slide into bases to avoid to be tagged comprising a) a top member having (i) inclined side walls with facing inner surfaces, said sidewalls being connected to define corners of a truncated frustrum of a pyramid, (ii) a top wall integrally connected to said side walls and defining both a curved surface and an under surface, (iii) a center member integrally connected to and descending from said under surface of said top wall, (iv) a first plurality of spaced ribs extending from said under surface of said top wall and radially connecting said center member with said midpoint of said inner surfaces of said side walls and the corners defined by the sidewalls, and (v) a second plurality of spaced ribs running substantially normal to and connecting the inner surfaces of opposing side walls at points intermediate said midpoints and said corners, said top member being comprised of resilient material and b) an anchor post connected to said center member for fastening said base to a base anchor secured to a playing field.

2. The base of claim 1 in which said side walls are inclined at an angle of 45° to a horizontal playing surface when said base is placed on the playing surface.

3. The base of claim 2 in which said top wall is a parabolically curved surface.

4. The base of claim 3 in which the lower edges of said side walls and said ribs are essentially co-planar.

5. The base of claim 4 in which said top wall and said side walls are between about ¼ and ½ inches thick.

6. The base of claim 1 in which said anchor post is integral with said center member.

7. A base secured to a horizontal playing field and constrained against horizontal movement comprising a) a top member having (i) inclined side walls with facing inner surfaces, said sidewalls being connected to define corners of a truncated frustrum of a pyramid, (ii) a top wall integrally connected to said side walls and defining both a curved surface and an under surface, (iii) a center member integrally connected to and descending from said under surface of said top wall, (iv) a first plurality of spaced ribs extending from said under surface of said top wall and radially connecting said center member with the midpoint of the inner surfaces of said side walls and said corners defined by said sidewalls, and (v) a second plurality of spaced ribs running substantially normal to and connecting the inner surfaces of opposing side walls at points intermediate said midpoints and said corners, said top member being comprised of resilient material and b) an anchor post connected to said center member for fastening said base to a base anchor secured to a playing filed, and c) a base anchor secured to the playing field, said member and said post being fastened together so as to prevent horizontal movement of said base.

8. The base of claim 7 in which at least two ribs connect said center member with each of said inner surfaces of said side walls.

9. The base of claim 8 in which said anchor post has a rectangular cross-section and said base anchor defines an opening of complimentary configuration for receiving said anchor post.

10. The base of claim 8 in which said top member has a flat flange abutting the top of said base anchor about said opening.

11. The base of claim 10 in which said side walls are inclined at an angle of not greater than 45° to a horizontal playing surface when said base is placed on the playing surface.

12. The base of claim 11 in which said top wall is a parabolically curved surface.

13. The base of claim 12 in which the lower edges of said side walls, the lower edges of said ribs and said flange are essentially co-planar and define a support surface for abutting a horizontal playing field.

14. The base of claim 13 in which said top wall and said side walls are between about ¼ and ½ inches thick.

* * * * *